US007024819B1

(12) United States Patent
Irvin et al.

(10) Patent No.: US 7,024,819 B1
(45) Date of Patent: Apr. 11, 2006

(54) AUTOMATIC DOOR CLOSING DEVICE

(75) Inventors: Gregory W. Irvin, Garland, TX (US); James A. McIntosh, Rowlett, TX (US); Michael A. McCafferty, McKinney, TX (US)

(73) Assignee: Xceltronix, Inc., Richardson, TX (US)

( * ) Notice: Subject to any disclaimer, the term of this patent is extended or adjusted under 35 U.S.C. 154(b) by 346 days.

(21) Appl. No.: 10/602,580

(22) Filed: Jun. 23, 2003

Related U.S. Application Data

(60) Provisional application No. 60/390,920, filed on Jun. 24, 2002.

(51) Int. Cl.
*E05F 15/20* (2006.01)

(52) U.S. Cl. ..... 49/29; 49/30; 49/25

(58) Field of Classification Search ..... 49/29, 49/25, 30, 506, 324, 70, 199; 160/188, 201, 160/1, 7, 310; 340/540, 545.1, 825.64, 542, 340/825.8, 5.23, 5.64, 5.71; 318/484, 480, 318/467, 280, 264–266, 283, 285, 286
See application file for complete search history.

(56) References Cited

U.S. PATENT DOCUMENTS 4,035,702 A 7/1977 Pettersen et al. ..... 318/285
4,365,250 A 12/1982 Matsuoka et al. ..... 340/825.32
4,463,292 A 7/1984 Engelmann ..... 318/283
5,027,553 A 7/1991 Vergara ..... 49/30
5,191,268 A * 3/1993 Duhame ..... 49/25
5,584,145 A * 12/1996 Teich ..... 49/506
5,752,343 A 5/1998 Quintus ..... 49/29
5,864,134 A 1/1999 Burgess ..... 250/221
5,878,530 A * 3/1999 Eccleston et al. ..... 49/139
6,046,562 A * 4/2000 Emil ..... 49/29
6,388,559 B1 * 5/2002 Cohen ..... 49/25
6,469,464 B1 10/2002 McCall ..... 318/445
RE37,986 E * 2/2003 Heitschel et al. ..... 49/25
6,563,278 B1 5/2003 Roman ..... 318/282
6,634,408 B1 * 10/2003 Mays ..... 49/25
6,860,065 B1 * 3/2005 Griffin et al. ..... 49/25
6,911,898 B1 * 6/2005 Chung ..... 49/25
6,914,401 B1 * 7/2005 Semelka ..... 49/25

* cited by examiner

*Primary Examiner*—Hugh B. Thompson, II
(74) *Attorney, Agent, or Firm*—Baker Botts L.L.P.

(57) ABSTRACT

A system includes a transmitter, a receiver, and a processor. The processor detects a trigger event. In response to the trigger event, the transmitter transmits a detection signal. If the receiver receives a reflected detection signal, the processor determines that a door is in a first position. Additionally, if the receiver receives a reflected detection signal, the processor signals an opener to move the door to a second position.

39 Claims, 3 Drawing Sheets

AUTOMATIC DOOR CLOSING DEVICE

RELATED APPLICATIONS

This application claims the benefit of U.S. Provisional Application Ser. No. 60/390,920 filed Jun. 24, 2002.

TECHNICAL FIELD OF THE INVENTION

This invention relates in general to automatic doors, and more particularly to a device for detecting and closing an open door.

BACKGROUND OF THE INVENTION

Widespread installation and use of automatic garage door openers have made entering and exiting garages significantly easier and faster. However, the convenience provided by automatic garage door openers has made it easy for users to become inattentive in opening and closing garage doors. Users may forget to close a door after exiting the garage, leaving the contents of the garage vulnerable to the elements, theft, or other causes of loss and damage.

SUMMARY OF THE INVENTION

In accordance with the present invention, the disadvantages and problems associated with automatic door openers have been substantially reduced or eliminated. In particular, the invention provides a method and system for ensuring a door equipped with an automatic door opener is closed.

In accordance with a particular embodiment, a method for monitoring the position of a door includes detecting a trigger event and transmitting a detection signal toward a predetermined location in response to the trigger event. The method further includes determining whether a reflected detection signal is received and determining a door is in a first position if the reflected detection signal is received. The method also includes transmitting an activation signal operable to move the door from the first position to a second position if the reflected detection signal is received.

In accordance with another embodiment, a system for monitoring the position of a door is provided. The system includes a transmitter operable to transmit signals, a receiver operable to receive signals, and a processor. The processor is operable to detect a trigger event, to transmit a detection signal in response to the trigger event, and determine whether a reflected detection signal is received. The processor is further operable to determine a door is in a first position if the reflected detection signal is received and to signal a door opener to move the door to a second position if the reflected detection signal is received.

Technical advantages of certain embodiments include protecting against a door being unintentionally left open. Other technical advantages of certain embodiments include the ability to utilize a previously installed conventional door opener.

Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

Figure 1:
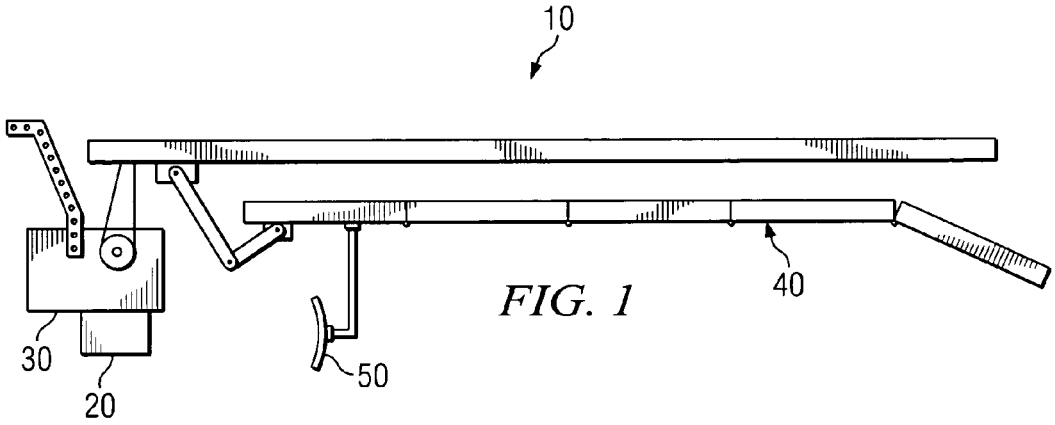
FIG. 1 illustrates a system according to one embodiment that includes a monitoring device, an opener, a door, and a reflector.

FIG. 1 shows a system 10 for monitoring a door 40 that includes a monitoring device 20, an opener 30, and a reflector 50. System 10 provides for automated monitoring and adjustment of the position of door 40.

Monitoring device 20 determines the position of door 40 and, when appropriate, instructs opener 30 to move door 40. Monitoring device 20 transmits a detection signal 60 (FIG. 2) in the general direction of door 40 and monitors for a reflection of the detection signal 60. Monitoring device 20 may include any appropriate combination of software and hardware suitable for carrying out the functions as described below.

Opener 30 moves door 40 between an open position and a closed position. In a particular embodiment, opener 30 may also move door 40 to one or more intermediate positions. Depending on the characteristics and configuration of system 10, opener 30 may be a conventional garage-door opener that is retrofitted by adding monitoring device 20. Opener 30 may include motors, sensing devices, and other suitable components for manipulating the position of door 40.

Door 40 may be a door of any type that is mounted in a manner allowing for a predetermined range of movement. Door 40 may be a garage door, driveway gate, or any other suitable type of door.

Reflector 50 may be a device of any material, shape, and character that is capable of reflecting signals of the type transmitted by monitoring device 20. Reflector 50 may be constructed and mounted to door 40 so that reflector 50 reflects signals only under certain conditions. In a particular embodiment, reflector 50 attaches to door 40 in such a manner that the orientation of reflector 50 changes as door 40 moves from an open position to a closed position. In such an embodiment, reflector 50 may reflect signals only when door 40 is in a particular position. For example, reflector 50 may be constructed and attached to door 40 so that reflector 50 reflects signals transmitted by monitoring device 20 when door 40 is in an open position but does not reflect signals when door 40 is in a closed position. Additionally, in a particular embodiment, reflector 50 may represent a portion of door 40 that is capable of reflecting detection signal 60.

Figure 2:
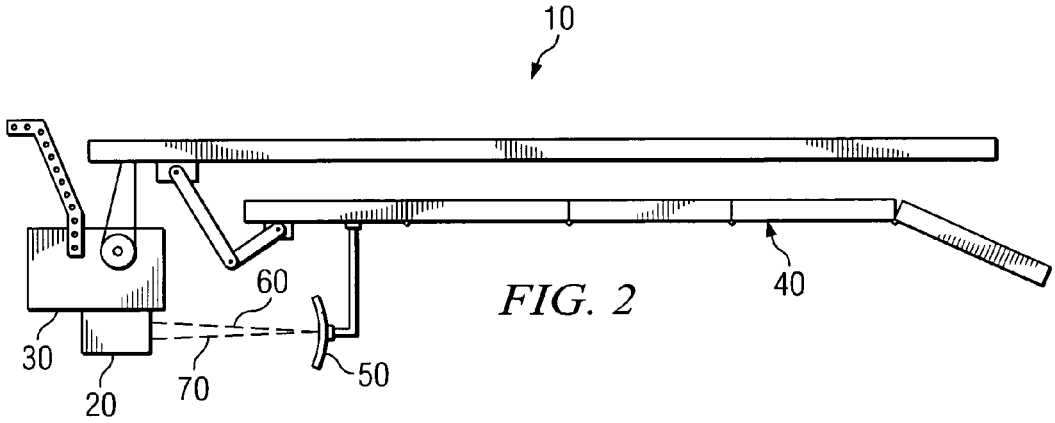
FIG. 2 illustrates operation of the system when the door is open.

FIG. 2 illustrates the operation of system 10 in a particular embodiment. In operation, monitoring device 20 detects a trigger event. The trigger event may be any event by which the monitoring device 20 may determine that it is appropriate to check the position of door 40. For example, in a particular embodiment of system 10, opener 30 may include a light that opener 30 turns on when opener 30 opens or closes door 40, and which opener 30 automatically turns off after a predetermined period of time. In such an embodiment, monitoring device 20 may include a light detector that detects that opener 30 has turned on the light, and the trigger event may represent the light turning off.

In another embodiment of system 10, a button by which a user may open door 40 couples to opener 30. In such an embodiment, monitoring device 20 may also couple to the button to detect that a user has pressed the button, and the trigger event may represent the button being pressed.

In yet another embodiment of system 10, monitoring device 20 may continuously and periodically monitor the position of door 40. In such an embodiment, the trigger event may represent monitoring device 20 detecting that door 40 has remained in an open position for greater than a threshold period of time. In general, system 10 can be configured to utilize the occurrence of any appropriate, detectable event as the trigger event.

In a particular embodiment, upon detecting the trigger event, monitoring device 20 may wait a predetermined period of time, or a delay time, before checking the position of door 40. For example, if the trigger event represents a user pushing a button control of opener 30 to open door 40, the delay time may allow time for the user to close the door 40 to prevent unnecessary interference by monitoring device 20. In another embodiment, system 10 may be configured to use a trigger event for which no delay is necessary, and monitoring device 20 may determine the position of door 40 immediately after detecting the trigger event.

Upon detecting the trigger event and waiting any appropriate delay time, monitoring device 20 determines the position or orientation of door 40. More specifically, monitoring device 20 generates a detection signal 60 and transmits the detection in the general direction of door 40 and reflector 50. Detection signal 60 may represent an infrared signal, an ultraviolet signal, or any other type of signal suitable for transmission by monitoring device 20 and for reflection by reflector 50. Additionally, in particular embodiments, monitoring device 20 may encode the detection signal 60 in a particular manner to limit interference from other devices utilizing the same type of signals. For example, in a particular embodiment, monitoring device 20 may encode detection signal 60 using on/off key (OOK) modulation.

Once transmitted, detection signal 60 travels toward door 40. Because of the position of door 40 and reflector 50 in FIG. 2, detection signal 60 strikes reflector 50. Detection signal 60 reflects back towards monitoring device 20 as reflected detection signal 70.

After transmitting detection signal 60, monitoring device 20 waits a predetermined period of time, a detection time, and then determines whether or not monitoring device 20 received reflected detection signal 70. Based on the detection of reflected detection signal 70 and the configuration and characteristics of system 10, monitoring device 20 determines the position of door 40. For example, in the embodiment illustrated in FIG. 2, monitoring device 20 determines that door 40 is in an open position when monitoring device 20 detects a reflected detection signal 70. In an alternative embodiment, the configuration of door 40 and reflector 50 may result in monitoring device 20 determining that door 40 is in a closed position when monitoring device 20 detects a reflected detection signal 70. For example, reflector 50 could be mounted flat against a surface of door 40 such that detection signal 60 is reflected when door 40 is in a closed position.

If monitoring device 20 determines that door 40 is in an open position, as door 40 is in FIG. 2, monitoring device 20 instructs opener 30 to move door 40 to a closed position. Opener 30 may then move door 40 to the closed position.

In a particular embodiment, prior to instructing opener 30 to move door 40 to a closed position, monitoring device 20 may generate a warning indication. The generation of a warning indication may include turning on a flashing light on monitoring device 20, generating an audible tone, or taking any other suitable action to alert a user that door 40 will soon be closed. In a particular embodiment, monitoring device 20 may generate a warning indication by instructing opener 30 to move door 40 to an intermediate position and then back to the open position. For example, opener 30 may move door 40 one quarter of the distance to the closed position and then back to the open position to alert users.

Monitoring device 20 may wait a predetermined period of time, a disable time, after generating the warning indication. If monitoring device 20 receives a disabling signal before the end of the disable time, monitoring device 20 may forgo instructing opener 30 to move door 40. For example, system 10 may include a disable button or a security scanner on monitoring device 20 or coupled to monitoring device 20. A user may then be given a predetermined amount of time to press the disable button or swipe a key fob across the security scanner, respectively, after the warning indication to prevent door 40 from closing.

Opener 30 may include safety settings that prevent opener 30 from closing door 40 under certain circumstances. For example, opener 30 may be capable of detecting objects in the path of door 40 and may be configured not to close door 40 if objects are detected in the path. In various embodiments, monitoring device 20 may or may not be configured to override any or all of these safety settings.

In a particular embodiment, after instructing opener 30 to move door 40 to a closed position, monitoring device 20 may attempt to verify that opener 30 moved door 40 to a closed position. In this particular embodiment, opener 30 may wait a predetermined period of time, or a verify time, before transmitting another detection signal 60. If monitoring device 20 again receives a reflected detection signal 70, monitoring device 20 may again instruct opener 30 to move door 40 to a closed position.

While the illustration and the preceding description focus on particular embodiments of system 10 that include specific elements providing particular functions, system 10 contemplates monitoring device 20 having any suitable combination and arrangement of elements providing functions to detect trigger events and determine the position of door 40. Thus, as noted above, the functionalities performed by the particular elements illustrated may be separated, distributed, and/or combined as appropriate.

For example, instead of including a reflector 50, a particular embodiment, may include a transmitter mounted to door 40. In this embodiment, instead of detecting a reflected detection signal 70, monitoring device determines the position of door 40 based on whether monitoring device 20 receives detection signal 60 transmitted by the transmitter on door 40.

Figure 3:
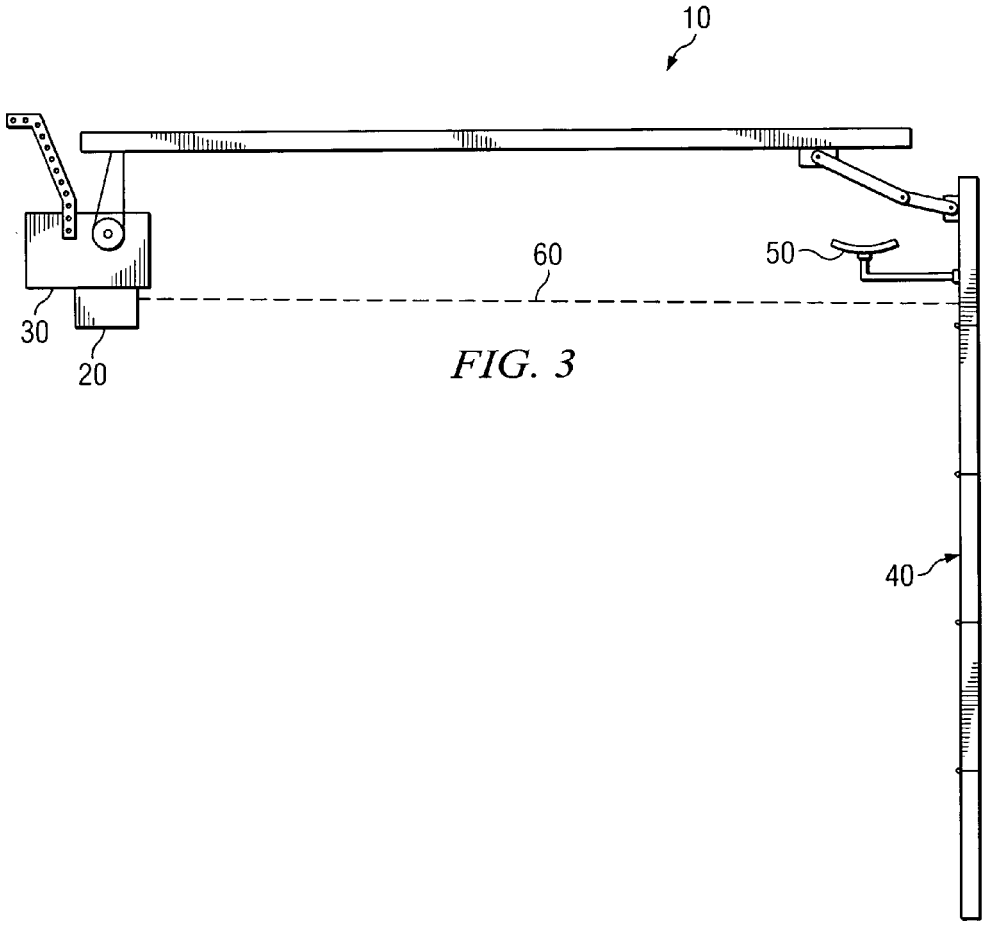
FIG. 3 illustrates operation of the system when the door is closed.

FIG. 3 illustrates operation of a particular embodiment of system 10 when door 40 is in a closed position. In the embodiment of FIG. 3, door 40 and reflector 50 are configured so that reflector 50 does not generate a reflection of detection signals 60 generated by monitoring device 20 when door 40 is in the closed position.

Similar to operation in FIG. 2, monitoring device 20 detects a trigger event. After detecting the trigger event and waiting any appropriate delay time, monitoring device 20 transmits a detection signal 60 as described above with respect to FIG. 2. Following the transmission of detection signal 60, monitoring device 20 waits until the detection time elapses and then determines the position of door 40 based on whether or not monitoring device 20 received a reflected detection signal 70. As a result of the configuration of the illustrated embodiment of system 10 and of the fact that door 40 is in a closed position in FIG. 3, monitoring device 20 does not detect a reflected detection signal 70. As a result, monitoring device 20 determines door 40 is in a closed position and does not instruct opener 30 to move door 40.

Figure 4:
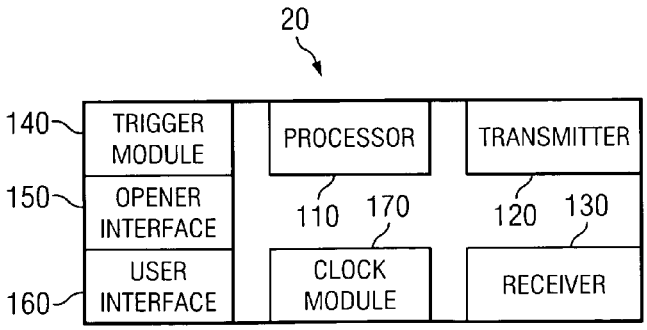
FIG. 4 is a block diagram illustrating components of the monitoring device according to a particular embodiment.

FIG. 4 is a block diagram illustrating particular components of monitoring device 20 according to a particular embodiment. Monitoring device 20 includes a processor 110, a transmitter 120, a receiver 130, a trigger module 140, an opener interface 150, a user interface 160 and a clock module 170. Each of the various components of monitoring device 20 may couple to one, some, or all of the other components of monitoring device 20 as appropriate to carry out the functions of monitoring device 20.

Processor 110 controls operation of various components of monitoring device 20 and performs computations to determine the position of door 40. Processor 110 may be a general purpose computer, dedicated microprocessor, or other processing device capable of communicating electronic information. Examples of processor 110 include application-specific integrated circuits (ASICs), field-programmable gate arrays (FPGAs), digital signal processors (DSPs) and any other suitable specific- or general-purpose processors.

Transmitter 120 generates and transmits a detection signal 60. Transmitter 120 may include an LED or any other appropriate device for generating transmission signals. Transmitter 120 may generate infrared beams, ultraviolet beams, visible light, or any other suitable signals. Additionally, transmitter 120 may include hardware and/or software suitable for encoding the signal generated by transmitter 120. Alternatively, processor 110 may provide transmitter 120 with an encoded data stream to use in generating detection signal 60.

Receiver 130 receives reflected detection signals 70 of detection signal 60. Receiver 130 may include a photodiode or any other appropriate device for receiving signals of the type generated by transmitter 120.

Trigger module 140 monitors various inputs and interfaces of monitoring device 20 to detect a trigger event. Trigger module 140 includes any suitable components, based on the configuration and characteristics of monitoring device 20, for determining that a trigger event has occurred. For example, if system 10 is configured to use a light turning off as the trigger event, trigger module 140 may include any components appropriate for detecting that the light has turned off. The components of trigger module 140 may include components that serve other functions in monitoring device 20. For example if the trigger event represents door 40 being open for longer than a threshold period of time, trigger module 140 may represent components of transmitter 120 and receiver 130 which are continually or periodically monitoring door 40.

Opener interface 150 allows monitoring device 20 to interact with opener 30. Using opener interface 150, monitoring device 20 can instruct opener 30 to move door 40. Opener interface 150 may communicate with opener 30 using a variety of techniques. In a particular embodiment, opener interface 150 communicates with opener 30 using the same control techniques that a user would, such as by mimicking the operation of a remote control associated with opener 30 or by coupling to a button control of opener 30. In another embodiment, opener 30 is modified when monitoring device 20 is installed and monitoring device 20 is hardwired to the control circuitry of opener 30. In general, monitoring device 20 may interact with opener 30 in either of these manners, or in any other appropriate fashion.

User interface 160 allows monitoring device 20 to interact with a user. User interface 160 may include indicators that allow monitoring device 20 to provide information to user and/or controls that allow user to affect operation of monitoring device 20. For example, user interface 160 may include LED indicators, tone generators, or other suitable components to alert users that monitoring device 20 is about to close door 40. As another example, user interface 160 may include a disable button or key fob scanner that allows users to prevent monitoring device 20 from closing door 40. In various embodiments, user interface 160 may include, or may couple to, components that provide various different indicators and controls as appropriate, based on the particular embodiment of monitoring device 20.

Clock module 170 includes timing components that may be used in the various functions performed by monitoring device 20. For example, in a particular embodiment of monitoring device 20, monitoring device 20 may pause for a predetermined period of time between particular operational steps. In such an embodiment, processor 110 may signal clock module 170 to initiate the timing of a predetermined period of time. Clock module 170 may time the predetermined period of time and then may signal processor 110 to indicate that the predetermined period of time has elapsed.

In general, although example components have been given, the functional elements of monitoring device 20 may include any appropriate combination of hardware and/or software for carrying out the functions described. Additionally, the various functional elements described may be divided among a variety of physical and/or logical components in various manners to correspond with the characteristics of a particular embodiment.

In operation, in a particular embodiment, trigger module 140 detects a trigger event. Trigger module 140 signals processor 110 that a trigger event has been detected. In a particular embodiment, after detecting a trigger event, trigger module 140 may stop checking for additional trigger events until processor 110 instructs trigger module 140 to once again check for trigger events.

In this particular embodiment, processor 110 signals clock module 170 to begin timing a predetermined period of time, a wait time. Once the wait time has expired, clock module 170 signals processor 110 to indicate that the wait time has elapsed. Processor 110 then instructs transmitter 120 to transmit detection signal 60. Processor 110 may do this by generating an encoded data stream and communicating the encoded data stream to transmitter 120 to be used to generate detection signal 60.

Transmitter 120 generates and transmits detection signal 60. Transmitter 120 may generate the detection signal 60 from the encoded data stream provided by processor 110. Transmitter 120 may also signal processor 110 to indicate transmission of the detection signal 60.

In this particular embodiment, processor 110 waits a predetermined period of time, or a detect time, after transmitter 120 transmits detection signal 60. Processor 110 may use clock module 170 to time the detect time. After the detect time has elapsed, processor 110 determines the position of door 40 based on whether receiver 130 has indicated receipt of reflected detection signal 70. If transmitter 120 used an encoded data stream from processor 110 to generate detection signal 60, processor 110 may also verify that reflected detection signal 70 matches the encoded data stream.

In the configuration of system 10 illustrated by FIG. 1, if receiver 130 signals processor 110 indicating receipt of reflected detection signal 70 before the detect time elapses, processor 110 determines door 40 is in an open position. If receiver 130 does not signal processor 110 indicating receipt of reflected detection signal 70 before the detect time elapses, processor 110 determines door 40 is in a closed position. This decision process will vary according to the configuration and characteristics of the particular embodiment of system 10.

If processor 110 determines that door 40 is in a closed position, processor 110 may signal trigger module 140 to begin checking for trigger events once again. If processor 110 determines door 40 is in an open position, monitoring device 20 may instruct opener 30 to move door 40 to a closed position.

Processor 110 may take steps to alert users that opener 30 will soon move door 30 to a closed position. In a particular embodiment, processor 110 may signal user interface 160 to instruct user interface 160 to alert users. User interface 160 may alert users through various indicators which may be located on, or coupled to, user interface 160, such as by flashing a light or generating an audible tone. Processor 110 may alert users by using opener interface 150 to instruct opener 30 to move door 40 to an intermediate position and back to the open position. In addition or as an alternative, processor 110 may alert users in any other suitable fashion.

After processor 110 signals user interface 160 to alert users, processor 110 may wait a predetermined period of time, or a disable time. Processor 110 may utilize clock module 170 to time the disable time. If user interface 160 signals processor 110 to indicate that a user has depressed a disable button, swiped a key fob at a security sensor, or otherwise indicated a desire for door 40 to remain in the open position, processor 110 may forgo any instructions to opener 30. Processor 110 may then signal trigger module 140 to begin checking for trigger events again.

If user interface 160 does not signal to processor 110 that a user has indicated a desire for door 40 to remain in the open position before the disable time elapses, processor 110 may signal opener interface 150 to instruct opener 30 to move door 40. As noted above, opener interface 150 may communicate with opener 30 in a variety of ways. In a particular embodiment, opener interface 150 couples to a button control of opener 30. In this embodiment, opener interface 150 provides signals similar to those generated by the button control when a user presses the button control. Utilizing whatever appropriate techniques opener interface 150 uses to communicate with opener 30, opener interface 150 instructs opener 30 to move door 40 to a closed position.

After signaling opener interface 150 to instruct opener 30 to move door 40 to a closed position, processor 110 signals trigger module 140 to begin checking for trigger events again. Trigger module 140 resumes checking for trigger events.

While the illustration and the preceding description focus on particular embodiments of monitoring device 20 that include specific elements providing particular functions, system 10 contemplates monitoring device 20 having any suitable combination and arrangement of elements providing functions to detect trigger events and determine the position of door 40. Thus, as noted above, the functionalities performed by the particular elements illustrated may be separated, distributed, and/or combined as appropriate. For example, while the illustrated embodiment includes a processor 110 responsible for generating an encoded data stream, in various embodiments transmitter 120 may include components responsible for providing the encoded data stream. Additionally, while specific functional elements are shown within monitoring device 20, system 10 contemplates providing some or all of these functionalities using logic, such as software, encoded in media.

Figure 5:
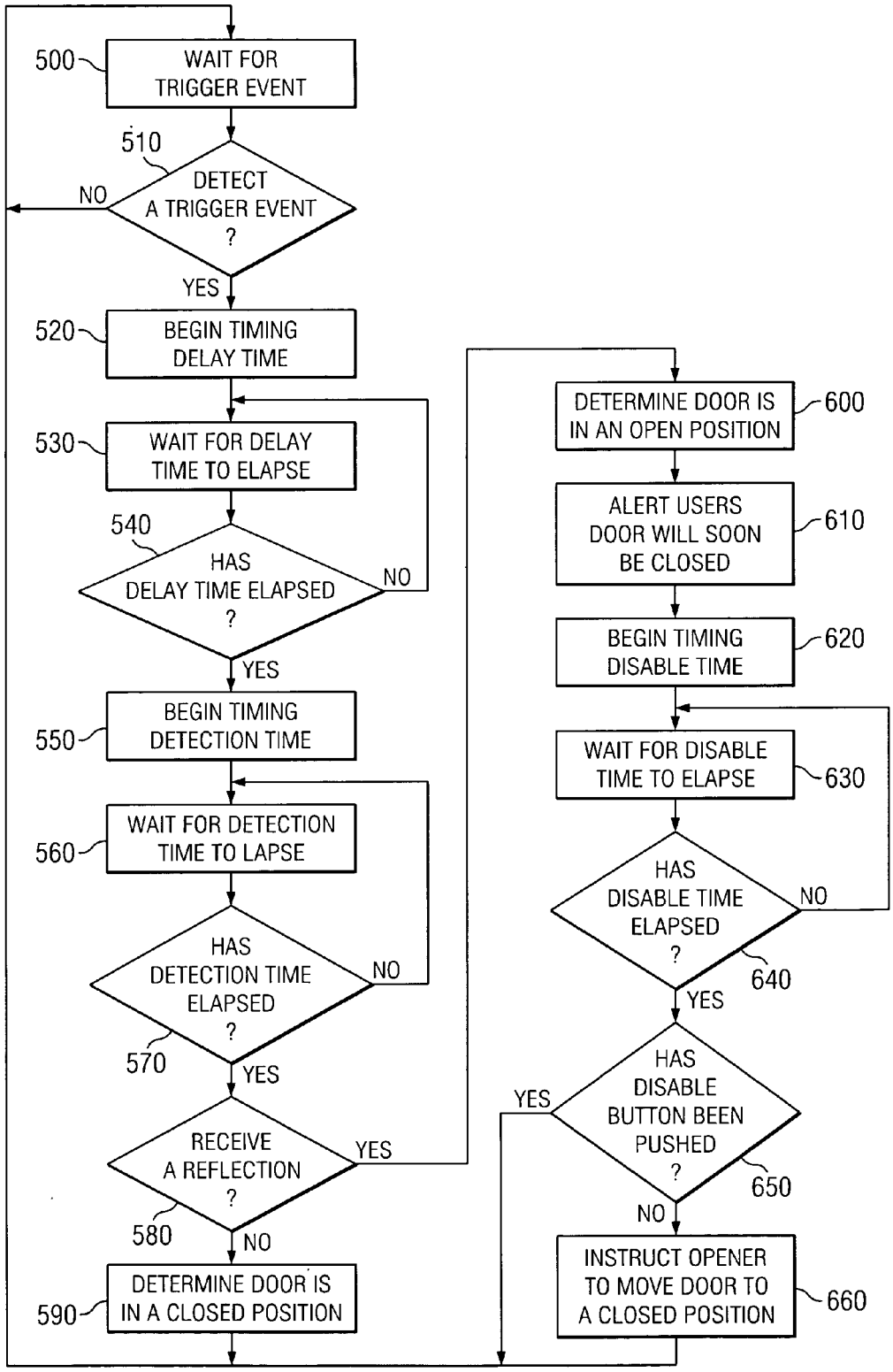
FIG. 5 is a flow chart illustrating operation of an embodiment of the system.

FIG. 5 is a flow chart illustrating operation of an embodiment of system 10. At step 500, monitoring device 20 waits for a trigger event. At step 510, monitoring device 20 determines whether monitoring device 20 detects a trigger event. If not, monitoring device 20 continues to wait for a trigger event at step 500.

If monitoring device 20 detects a trigger event, monitoring device 20 begins timing a delay time at step 520. At step 530, monitoring device 20 waits. At step 540, monitoring device 20 determines whether the delay time has elapsed. If not, monitoring device 20 continues to wait at step 530.

If the delay time has elapsed, monitoring device 20 transmits a detection signal 60 and starts timing a detection time at step 550. Monitoring device 20 waits for the detection time to elapse at step 560. At step 570, monitoring device 20 determines whether the detection time has elapsed. If not, monitoring device 20 continues to wait at step 560.

If the detection time has elapsed, monitoring device 20 determines whether or not monitoring device 20 received reflected detection signal 70 at step 580. If not, monitoring device 20 determines door 40 is in a closed position at step 590 and returns to step 500.

If monitoring device 20 has received a reflected detection signal 70, monitoring device 20 determines that door 40 is in an open position at step 600. Monitoring device 20 alerts users that opener 30 will soon close door 40 at step 610. Monitoring device 20 begins timing the disable time at step 620. Monitoring device 20 waits for the disable time to elapse at step 630. At step 640, monitoring device 20 determines whether the disable time has elapsed. If not, monitoring device 20 continues to wait at step 630.

If disable time has elapsed, monitoring device 20 determines at step 650 whether a disable button has been pushed. If so, monitoring device 20 returns to waiting for a trigger event at step 500.

If the disable button has not been pushed device 20 instructs opener 30 to move door 40 to a closed position at step 660. Monitoring device 20 returns to waiting for a trigger event at step 500.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the scope of the appended claims.

What is claimed is:

1. A method for monitoring the position of a door, comprising:
detecting a trigger event;
transmitting a detection signal toward a predetermined location in response to the trigger event;
determining whether a reflected detection signal is received;
determining that a door is in a first position if the reflected detection signal is received; and
in response to determining the door is in the first position:
generating a warning indication; and
transmitting an activation signal operable to move the door to a second position if a disable signal is not received within a predetermined period of time.

2. The method of claim 1, further comprising waiting a second predetermined period of time between detecting the trigger event and transmitting the detection signal.

3. The method of claim 1, wherein the detection signal is encoded.

4. The method of claim 1, wherein detecting a trigger event comprises detecting a light has turned off.

5. The method of claim 1, wherein detecting a trigger event comprises detecting a button has been pushed.

6. The method of claim 1, wherein generating the warning indication comprises:
transmitting an activation signal operable to move the door from the first position to a third position;
waiting a second predetermined period of time; and
transmitting an activation signal operable to move the door from the third position to the first position.

7. The method of claim 1, wherein the detection signal comprises an ultraviolet signal.

8. The method of claim 1, wherein the detection signal comprises an infrared signal.

9. The method of claim 1, further comprising:
transmitting a second detection signal toward a predetermined location after transmitting the activation signal;
determining whether a second reflected detection signal is received after transmitting the second detection signal;
determining that a door is in a first position if the second reflected detection signal is received; and
transmitting a second activation signal operable to move the door to a second position if the second reflected detection signal is received.

10. A system for detecting the position of a door, comprising:
means for detecting a trigger event;
means for transmitting a detection signal in response to the trigger event;
means for checking for a reflected detection signal;
means for determining a door is in a first position in response to receiving the reflected detection signal;
means for generating a warning indication in response to determining the door is in the first position; and
means for transmitting, in response to determining the door is in the first position, an activation signal if a disable signal is not received within a predetermined period of time, the activation signal operable to move the door to a second position.

11. A system for monitoring the position of a door comprising:
a transmitter operable to transmit a detection signal;
a receiver operable to receive a reflected detection signal; and
a processor operable to:
detect a trigger event;
transmit a detection signal in response to the trigger event;
determine whether a reflected detection signal is received;
determine a door is in a first position if the reflected detection signal is received; and
in response to determining the door is in the first position:
generate a warning indication; and
signal a door opener to move the door to a second position if the processor does not detect a disable signal within a predetermined period of time.

12. The system of claim 11, wherein the detection signal comprises an encoded detection signal.

13. The system of claim 11, wherein the processor is further operable to detect a trigger event by detecting a light has turned off.

14. The system of claim 11, wherein the processor is further operable to detect a trigger event by detecting a button has been pushed.

15. The system of claim 11, wherein the processor is operable to generate the warning indication by
signaling the door opener to move the door to a third position;
waiting a second predetermined period of time; and
signaling the door opener to move the door from the third position to the first position.

16. The system of claim 11, wherein the detection signal comprises an ultraviolet signal.

17. The system of claim 11, wherein the detection signal comprises an infrared signal.

18. The system of claim 11, wherein the processor is further operable to:
transmit a second detection signal toward a predetermined location after signaling the door opener to move the door to the second position;
determine whether a second reflected detection signal is received after transmitting the second detection signal;
determine that the door is in the first position if the second reflected detection signal is received; and
signal the door opener a second time to move the door to a second position in response to determining that the door is in the first position.

19. The system of claim 11, wherein the processor is further operable to:
transmit a second detection signal toward a predetermined location a predetermined period of time after transmitting the activation signal;
determining whether a second reflected signal is received after transmitting the second detection signal; and
transmitting a second activation signal operable to move the door to the second location if the second reflected detection signal is received.

20. A system for monitoring the position of a door comprising:
a transmitter operable to transmit a detection signal;
a receiver operable to receive a reflected detection signal;
a door opener operable to move a door between a first position and a second position;
a reflector, mounted on a door and operable to reflect the detection signal transmitted by the transmitter; and
a processor operable to:
detect a trigger event;
transmit a detection signal in response to the trigger event;
determine whether a reflected detection signal is received;
determine the door is in a first position if the reflected detection signal is received; and
in response to determining the door is in the first position:

generate a warning indication; and signal the door opener to move the door to a second position if the processor does not detect a disable signal within a predetermined period of time.

21. The system of claim 20, wherein the processor is further operable to detect a trigger event by detecting a light has turned off.

22. The system of claim 20, wherein the processor is further operable to detect a trigger event by detecting a button has been pushed.

23. The system of claim 20, wherein the processor is further operable to:

transmit a second detection signal toward a predetermined location a predetermined period of time after transmitting the activation signal;

determining whether a second reflected signal is received after transmitting the second detection signal; and transmitting a second activation signal operable to move the door to the second location if the second reflected detection signal is received.

24. A method for monitoring the position of a door, comprising:

detecting a trigger event;

transmitting a detection signal toward a predetermined location in response to the trigger event;

determining whether a reflected detection signal is received;

determining that a door is in a first position if the reflected detection signal is received; and in response to determining the door is in the first position:

transmitting an activation signal operable to move the door to a second position;

transmitting a second detection signal toward a predetermined location after transmitting the activation signal;

determining whether a second reflected detection signal is received after transmitting the second detection signal;

determining that the door is in the first position if the second reflected detection signal is received; and transmitting a second activation signal operable to move the door to the second position in response to determining the door is in the first position.

25. The method of claim 24, further comprising waiting a predetermined period of time between detecting the trigger event and transmitting the first detection signal.

26. The method of claim 24, wherein the detection signal is encoded.

27. The method of claim 24, wherein detecting the trigger event comprises detecting a light has turned off.

28. The method of claim 24, wherein detecting the trigger event comprises detecting a button has been pushed.

29. The method of claim 24, wherein the detection signal comprises an ultraviolet signal.

30. The method of claim 24, wherein the detection signal comprises an infrared signal.

31. A system for monitoring the position of a door comprising:

a transmitter operable to transmit a detection signal;

a receiver operable to receive a reflected detection signal; and a processor operable to:

detect a trigger event;

transmit a detection signal in response to the trigger event;

determine whether a reflected detection signal is received;

determine that a door is in a first position if the reflected detection signal is received; and in response to determining the door is in the first position:

signal a door opener to move the door to a second position;

transmit a second detection signal toward a predetermined location after signaling the door opener to move the door to the second position;

determine whether a second reflected detection signal is received after transmitting the second detection signal;

determine that the door is in the first position if the second reflected detection signal is received; and signal the door opener a second time to move the door to a second position in response to determining that the door is in the first position.

32. The system of claim 31, wherein the detection signal comprises an encoded detection signal.

33. The system of claim 31, wherein the processor is further operable to detect a trigger event by detecting a light has turned off.

34. The system of claim 31, wherein the processor is further operable to detect a trigger event by detecting a button has been pushed.

35. The system of claim 31, wherein the detection signal comprises an ultraviolet signal.

36. The system of claim 31, wherein the detection signal comprises an infrared signal.

37. A system for monitoring the position of a door comprising:

a transmitter operable to transmit a detection signal;

a receiver operable to receive a reflected detection signal;

a door opener operable to move a door between a first position and a second position;

a reflector, the reflector mounted on a door and operable to reflect the detection signal transmitted by the transmitter; and a processor operable to:

detect a trigger event;

transmit a detection signal in response to the trigger event;

determine whether a reflected detection signal is received;

determine that the door is in the first position if the reflected signal is received; and in response to determining that the door is in the first position:

signal the door opener to move the door to a second position;

transmit a second detection signal toward a predetermined location a predetermined period of time after signaling the door opener to move the door to the second position;

determine whether a second reflected detection signal is received after transmitting the second detection signal;

determine that the door is in the first position if the second reflected detection signal is received; and signal the door opener a second time to move the door to the second position if the second reflected detection signal is received.

38. The system of claim 37, wherein the processor is further operable to detect a trigger event by detecting a light has turned off.

39. The system of claim 37, wherein the processor is further operable to detect a trigger event by detecting a button has been pushed.

* * * * *